US005544579A

United States Patent [19]

Gallagher et al.

[11] Patent Number: 5,544,579

[45] Date of Patent: Aug. 13, 1996

[54] MAILING MACHINE INCLUDING OVERRIDEABLE SHEET LENGTH DISCRIMINATING STRUCTURE

[75] Inventors: Dennis M. Gallagher, Danbury; Thomas M. Pfeifer, Bridgeport; Richard P. Schoonmaker, Wilton, all of Conn.

[73] Assignee: Pitney Bowes Inc., Stamford, Conn.

[21] Appl. No.: 991,899

[22] Filed: Dec. 17, 1992

[51] Int. Cl.[6] ..... B41L 47/46

[52] U.S. Cl. ..... 101/91; 400/582

[58] Field of Search ..... 400/578, 582, 400/596, 624, 625, 629, 630, 708; 101/91; 271/256, 258, 259, 265

[56] References Cited

U.S. PATENT DOCUMENTS

| | | | |
|---|---|---|---|
| 4,727,437 | 2/1988 | Mizoguchi | 400/708 X |
| 5,035,413 | 7/1991 | Yamada et al. | 400/624 X |

FOREIGN PATENT DOCUMENTS

| | | | |
|---|---|---|---|
| 0137484 | 10/1981 | Japan | 400/708 |
| 0018371 | 1/1985 | Japan | 400/708 |
| 0058784 | 3/1986 | Japan | 400/708 |
| 0077769 | 4/1988 | Japan | 400/708 |
| 0009666 | 1/1990 | Japan | 400/708 |
| 2221655 | 2/1990 | United Kingdom | 400/708 |

*Primary Examiner*—Christopher A. Bennett

*Attorney, Agent, or Firm*—Angelo N. Chaclas; Melvin J. Scolnick

[57] ABSTRACT

A mailing machine comprising, structure for feeding a sheet in a path of travel, structure for printing indicia on the sheet, structure for controlling the sheet feeding and printing structure, the controlling structure including a microprocessor, the controlling structure including structure for sensing the sheet in the path of travel, the sensing structure including a first sensor for sequentially sensing the leading and trailing edges of the sheet and providing corresponding sequential first signals to the microprocessor, the sensing structure including a second sensor downstream from the first sensor for sensing the leading edge of the sheet and providing a corresponding second sensing signal to the microprocessor, and the microprocessor programmed for causing the sheet feeding structure to feed the sheet, commencing a count of a first time interval when the trailing edge of the sheet is sensed by the first sensor, determining whether the first time interval count is less than a predetermined second time interval when the leading edge of the sheet is sensed by the second sensor, and terminating sheet feeding if the first time interval count is not less than the predetermined second time interval.

8 Claims, 4 Drawing Sheets

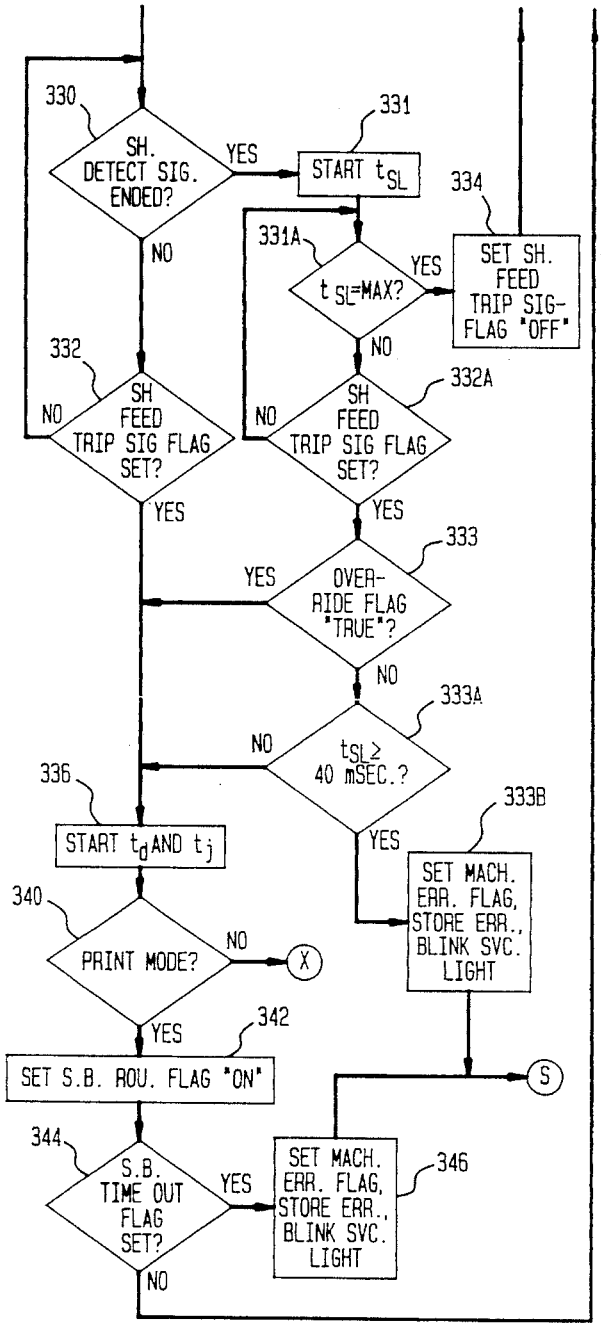
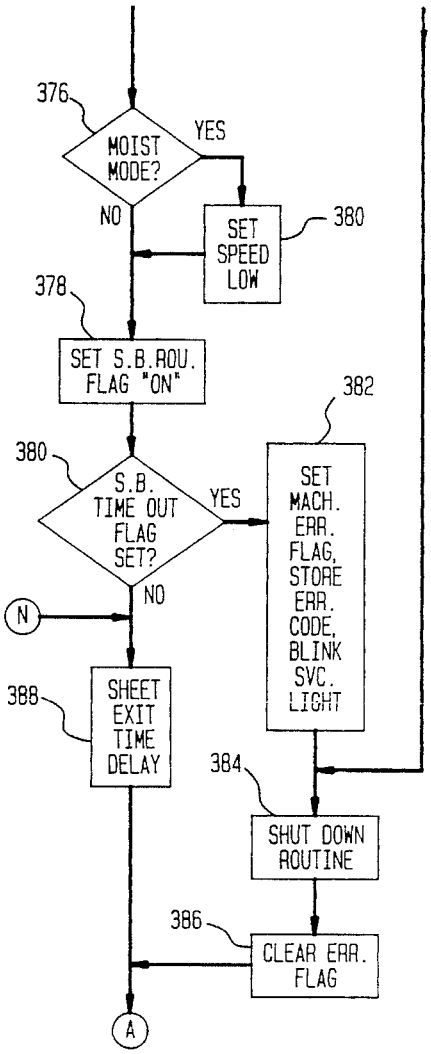
FIG. 3B
FIG. 3
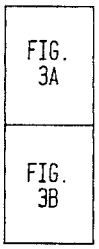

MAILING MACHINE INCLUDING OVERRIDEABLE SHEET LENGTH DISCRIMINATING STRUCTURE

The present invention is generally concerned with a mailing machine including sheet feeding and printing structures, and more particularly with a mailing machine including improved means for discriminating between sheets of acceptable and unacceptable length for processing purposes.

BACKGROUND OF THE INVENTION

As shown in U.S. patent application Ser. No. 07/841,912 for a Mailing Machine Including Short Sheet Length Detecting Means, filed Feb. 25, 1992 by Alton B. Eckert, Jr. et. al., now U.S. Pat. No. 5,380,109, and assigned to the assignee of the present invention, it is known in the art to provide a mailing machine with means for sensing a sheet in a path of travel, and with a microprocessor programmed for determining whether the overall length of the sheet corresponds to a minimum overall length by counting the time interval the sheet is disposed in blocking relationship with the sensing means and comparing that time interval to a predetermined time period for feeding a sheet of acceptable length. Although such structure is suitable for use in some mailing machines it is not suitable for use in all mailing machines, for example, in a mailing machine wherein the geometry of the machine is such that the distance between two sensors of the machine, which are utilized for measuring a sheet length, is less than the minimum acceptable sheet length, or sheets are fed through the machine at different speeds. Accordingly:

an object of the invention is to provide a mailing machine including sheet feeding and printing structure, and including means for discriminating between sheets of different lengths for processing purposes;

another object is to provide a mailing machine including overrideable means for discriminating between sheets having an acceptable or unacceptable minimum length for processing; and another object is to provide a mailing machine including two speed sheet feeding means in combination with overrideable means for differently processing sheets of different lengths.

SUMMARY OF THE INVENTION

A mailing machine comprising, means for feeding a sheet in a path of travel, means for printing indicia on the sheet, means for controlling the sheet feeding and printing means, the controlling means including a microprocessor, the controlling means including means for sensing the sheet in the path of travel, the sensing means including a first sensor for sequentially sensing the leading and trailing edges of the sheet and providing corresponding sequential first signals to the microprocessor, the sensing means including a second sensor downstream from the first sensor for sensing the leading edge of the sheet and providing a corresponding second sensing signal to the microprocessor, and the microprocessor programmed for causing the sheet feeding means to feed the sheet, commencing a count of a first time interval when the trailing edge of the sheet is sensed by the first sensor, determining whether the first time interval count is less than a predetermined second time interval when the leading edge of the sheet is sensed by the second sensor, and terminating sheet feeding if the first time interval count is not less than the predetermined second time interval.

BRIEF DESCRIPTION OF THE DRAWINGS

As shown in the drawings wherein like reference numerals designate like or corresponding parts throughout the several views.

DESCRIPTION OF THE PREFERRED EMBODIMENTS

Figure 1:
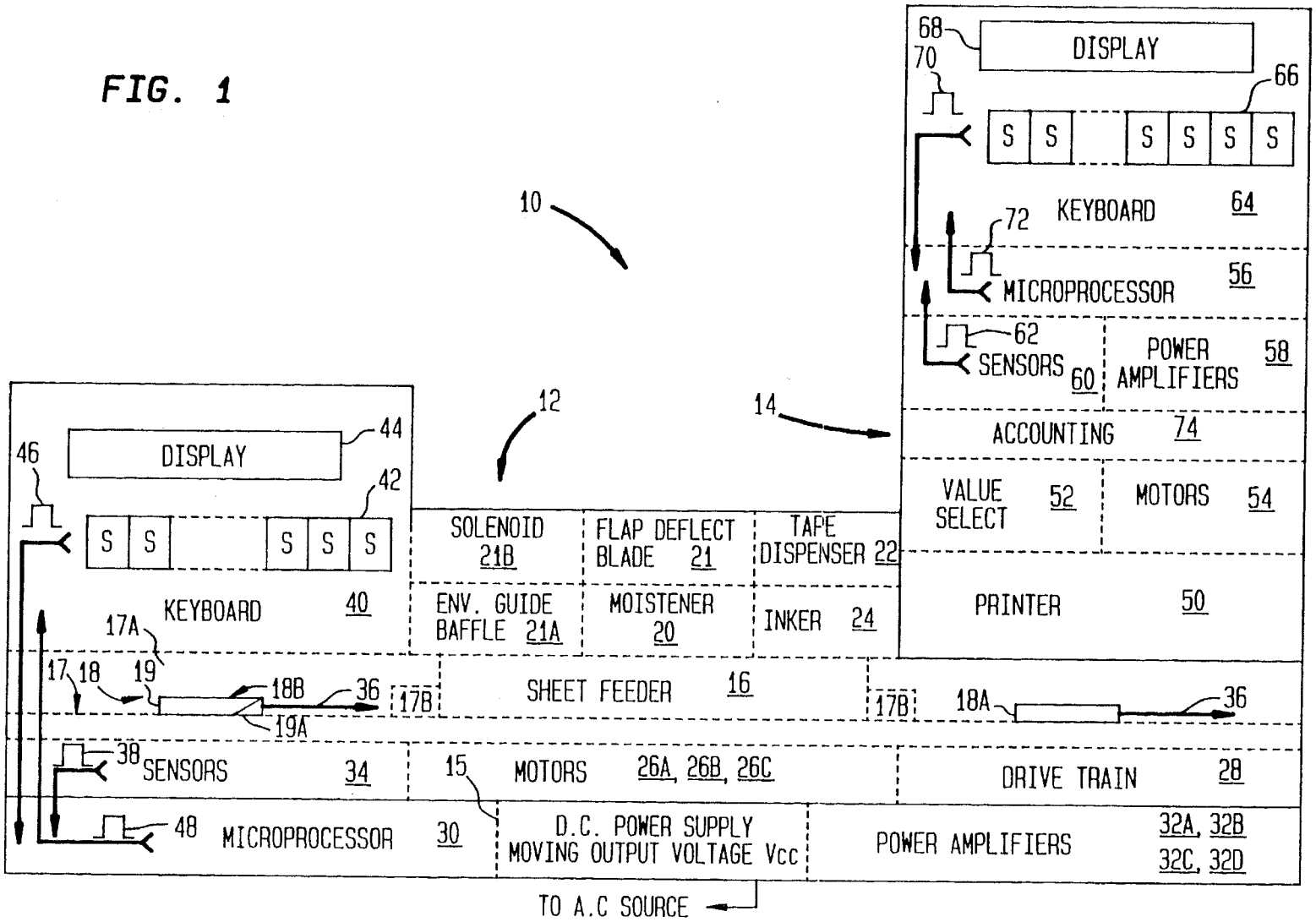
FIG. 1 is a schematic view of an improved mailing machine according to the invention.
Figure 2:
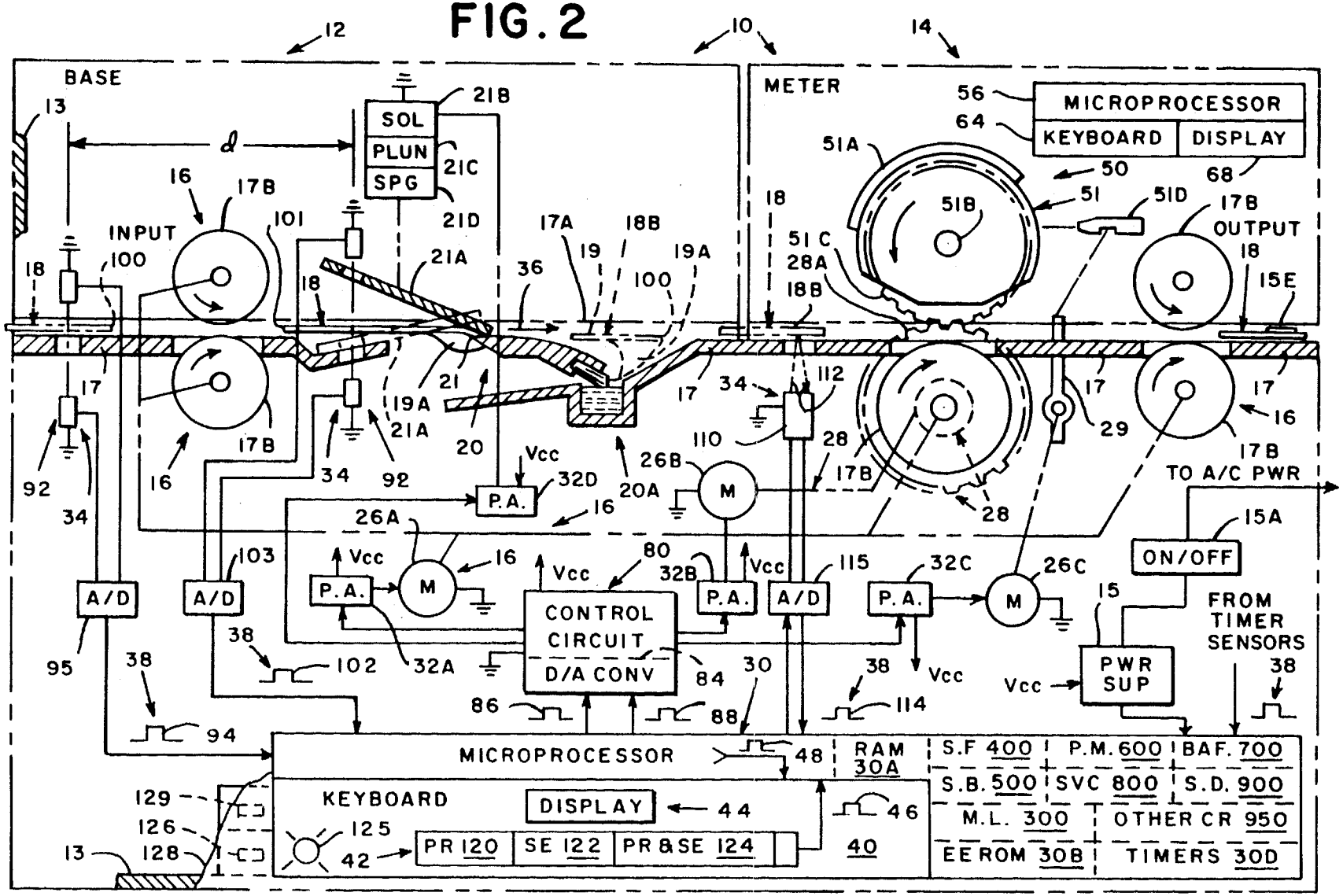
FIG. 2 is a schematic view of the mailing machine of FIG. 1 showing the envelope feeding, flap guiding, flap deflecting, moistening, printing and sensing structures thereof for discriminating between different lengths of sheets for processing.

As shown in FIGS. 1 and 2, a mailing machine 10 according to the invention generally includes an improved mailing machine base 12, having suitable framework 13 for supporting the various components thereof, and includes a conventional postage meter 14 which is suitably removably connected to the base 12.

The mailing machine base 12 (FIGS. 1 and 2) preferably includes a conventional source of supply 15 of d.c. power, having a d.c. output voltage level Vcc. The d.c. supply 15 is suitably adapted to be connected to an external source of supply of a.c. power via a two position, i.e., "on" and "off", power switch 15A, for energization thereof, and thus of the base 12. In addition, the base 12 comprises conventional sheet feeding structure 16, including an elongate horizontally-extending deck 17, an upright registration fence 17A extending alongside of and longitudinally of the length of the deck 17, and a plurality of rollers 17B, which may be one or more belts, or the like, for feeding successive sheets 18 on the deck 17 through the machine 10. Without departing from the spirit and scope of the invention, a given sheet 18, having a leading edge 100 and a trailing edge 101, may be a cut tape 18A, a card, or folded or unfolded letter, or a sealed or unsealed envelope 18B having a body 19, and having a flap 19A. And, the envelope body 19 may be stuffed with one or more cards, folded or unfolded letters, invoices, remittance slips or return envelopes, or other sheets 18. In addition, the mailing machine base 12 includes envelope flap moistening structure 20, including a suitable source of supply of water 20A and a suitable envelope flap deflecting blade 21 for guiding envelope flaps 19A into moistening relationship with the moistening structure 20. Further, the mailing machine 12 includes a baffle 21A, and includes a solenoid 21B having a plunger 21C which is connected to the baffle 21A and loaded by a spring 21D, such that the solenoid 21B is operable against the force of the spring 21D to pivotably move the baffle 21A above the deck 17, for guiding sheets 18 toward the flap deflecting blade 21 for moistening, and such that the solenoid 21B is operable for permitting the spring to position the baffle 21A beneath the deck 17, for guiding sheets 18 away from the flap deflecting blade 21 for bypassing the moistening structure 20. Moreover, the base 12 preferably includes conventional cut tape dispensing structure 22, including a suitable receptacle for receiving and storing a stack of cut tapes 18A and including conventional structure for feeding the cut tapes 18A one at a time from the receptacle. And, the base 12 preferably includes conventional inking structure 24, such as a suitable source of supply of ink, which may be a reservoir of ink or an ink saturated roller and one or more rollers associated therewith for transferring ink therefrom to the printing structure, hereinafter discussed, of the postage meter 14. Still further, the mailing machine base 12 preferably includes a plurality of conventional d.c. motors 26A, 26B and 26C, one of which, 26A, is suitably connected to the sheet feeding structure 16, for operation thereof, another of which, 26B, is suitably connected to a conventional drive train 28, including a drive gear 28A which is constructed and arranged for transferring motive power to the postage meter 14 for driving the printing structure hereinafter discussed, and another of which, 26C, is suitably connected to the shutter bar 1ever arm 29 for moving a shutter bar as hereinafter discussed into and out of locking engagement with a postage meter drum drive gear driven by the gear 28A.

For controlling the mailing machine base 12 (FIGS. 1 and 2), the base 12 generally includes a conventional microprocessor 30, and a plurality power amplifiers 32A, 32B, 32C and 32D which are each connected to a different one of the motors and solenoid 26A, 26B, 26C and 21B. And, for controlling the base 12, the base 12 preferably includes the control circuit 80 hereinafter described for controlling each of the power amplifiers 32A, 32B, 32C and 32D, and thus the motors and solenoid 26A, 26B, 26C and 21B. Further, for controlling the base 12, the base 12 includes a plurality of conventional sensors 34 which are suitably located relative to one or more components of the sheet feeding structure 16, baffle 21A, solenoid 21B, cut tape dispensing structure 22, inking structure 24, motors 26A, 26B and 26C, and drive train 28, and relative to the path of travel 36 of respective sheets 18 fed through the machine 10, for providing signals, such as the signal 38, to the microprocessor 30 which are indicative of the position of the plunger of the solenoid 21B, of the angular velocity of the respective motors 26A, 26B and 26C, of the position of the baffle 21A and selected components of the drive train and sheet feeding structures, 16 and 28, of one or more positions of selected components of the structures 22, 24 and 26, of the available supply of water or ink, as the case may be, in the moistening and inking structures, 20 and 24, and of one or more positions of a given sheet 18, including a given cut tape 18A or envelope 18B, in the path of travel 36. Still further, for controlling the mailing machine base 12, the base 12 additionally comprises a conventional keyboard 40, including a plurality of switches 42 and a suitable display 44 which are conventionally electrically connected to the microprocessor 30 for providing thereto conventional signals, such as the signal 46, for causing the microprocessor 30 to control the base 12, and receiving therefrom conventional signals, such as the signal 48, for driving the display 44. Moreover, the microprocessor 30 is conventionally programmed for, inter alia, responding to signals 38 received from the sensors 34, and to signals 46 received from the keyboard 40 due to manual actuation of the switches 42, for timely causing operation of the motors 26A, 26B and 26C, and thus of the drive train and sheet feeding structures 16 and 28, and timely causing operation of the solenoid 21B, to cause envelopes 18B to be transported by the sheet feeding structure 16, guided into or out of flap deflecting relationship with the flap deflecting blade 21 by the envelope guiding baffle 21A, and causing sheets 18 to be transported by the sheet feeding structure 16 through the machine 10, and for timely causing the printing structure of the postage meter 14 to print postage indicia on the respective sheets 18 including tapes 18A and envelopes 18B. And, to that end, the microprocessor 30 is conventionally programmed to include a main line program 300 and a plurality of sub-programs, including, inter alia, a sheet feeding routine 400, shutter bar routine 500, postage meter printing routine 600, envelope guiding baffle routine 700, service routine 800, shut-down routine 800, and other conventional routines 950 for implementing the aforesaid functions and other functions hereinafter discussed.

The postage meter 14 (FIGS. 1 and 2) preferably comprises conventional postage indicia printing structure 50, which is preferably a conventional rotary printing drum 51, having a suitable printing die 51A for printing an indicia 51E on a sheet 18. In addition, the postage meter 14 includes a drum drive shaft 51B on which there is mounted a drum drive gear 51C which is dimensioned for meshing engagement with the drive train gear 28A of the mailing machine base 12. Accordingly, the postage meter 14 is constructed and arranged for interfacing with the drive train 28 of the mailing machine base 12 when the postage meter 14 is removably connected thereto. Further, the postage meter 14 includes a shutter bar 51D, which is conventionally disposed in bearing engagement with the shutter bar lever arm 29, when the meter 14 is connected to the base 12, for movement by the lever am 29 into and out of locking engagement with the drum drive gear 51C. For changing the postage value of the postage indicia 51E printed by the die 51A, the postage meter 14 additionally includes conventional value selection structure 52, such as a plurality of conventional printing wheels and a drive train therefor, and also includes one or more motors 54, such as stepper motors, which are respectively conventionally coupled to the drive trains of the value selection structure 52.

For controlling the postage meter 14 (FIGS. 1 and 2) the postage meter 14 includes a conventional microprocessor 56, and includes one or more power amplifiers 58 which are respectively connected between the microprocessor 56 and a different motor 54. Further, for controlling the postage meter 14, the meter 14 includes a plurality of conventional sensors 60 which are suitably located relative to one or more components of the printing structure 50, value selection structure 52, motors 54 and the path of travel 36 of respective sheets 18 fed through the machine 10, for providing signals, such as the signal 62, to the microprocessor 56 which are indicative of one or more positions of selected components of the structures 50, 52 and 54, and of one or more positions of a given sheet 18, in the path of travel 36. Still further, for controlling the postage meter 14, the meter 14 additionally comprises a conventional keyboard 64, including a plurality of suitable switches 66 and a suitable display 68 which are conventionally electrically connected to the microprocessor 56 for providing thereto conventional signals, such as the signal 70, for causing the microprocessor 56 to control the postage meter 14, and for receiving therefrom conventional signals, such as the signal 72, for driving the display 68. Moreover, for controlling the postage meter 14, the meter 14 includes conventional accounting structure 74. The accounting structure 74 is suitably electrically connected to the microprocessor 56 for communicating therewith, and includes, inter alia, data stored therein which corresponds to the current total value of postage available for printing by the meter 14, the current total value of postage printed by the meter 14 and the serial number of the meter 14. And, for controlling the meter 14, the microprocessor 56 is conventionally programmed, inter alia, for responding to value selection signals 70 received from the keyboard 64 due to manual actuation of the switches 66, for causing the microprocessor 56 to energize the motors 54, thereby causing the value selection structure 52 to position the print wheels to print an indicia 51E having a postage value corresponding to the value selection signals 70, for causing the microprocessor 56 to access the accounting structure 74 to determine whether or not sufficient total postage is available for printing and, if so, to deduct therefrom an amount corresponding to the value selection signals 70 and to add the same amount to the total value printed, and, for causing the printing structure 50 to be unlocked to permit the printing of single postage indicia 51E, including the amount corresponding to the value selection signals 70, on a given sheet 18 under the control of the postage meter base 12.

As shown in FIG. 2, the postage meter base 14 preferably includes a multiple channel, pulse width modulated (PWM), load control circuit 80, which is connected to the microprocessor 30. The circuit 80 includes digital to analog converter structure 84 having clock "c" and data "d" input leads electrically connected to the microprocessor 30 for receiving conventional signals, such as the signals 86 and 88, from the microprocessor 30 for controlling the converter structure 84, and thus the control circuit 80, for selectively providing different pulse width modulated signals to each of the power amplifiers 32A, 32B, 32C and 32D, for driving the respective motors 26A, 26B and 26C, and the solenoid 21B. A more detailed description of the control circuit 80 may be found in U.S. patent application Ser. No. 07/983,912 for a Mailing Machine Including Multiple Channel Pulse Width Modulated Signal Circuit, filed Dec. 1, 1992 by T. Pfeiffer, et. al., now U.S. Pat. No. 5,331,539, and assigned to the assignee of the present invention (Applicant's file C-968).

As shown in FIG. 2, sheets 18, including envelopes 18B, fed through the machine 10 are fed downstream in the path of travel 36, as indicated by the arrow. Preferably, one of the sensors 34, i.e., sensor 92, is located upstream from the sheet feeding rollers 17B of the mailing machine base 10 for sensing respective sheets 18 as they are initially fed to the machine 10 and providing a signal 38 to the microprocessor 30, such as the signal 94 via an analog to digital converter 95, indicating that a sheet 18 has been fed to the machine 10. In addition, one of the sensors 34, i.e., sensor 96, is located downstream from the sensor 92, and from the input feed rollers 17B, i.e., the feed rollers 17B located upstream of the guide baffle 21A, for sensing the leading edges 100 of successive sheets 18, as they are initially fed downstream in the path of travel 36 by the input sheet feeding rollers 17B, and providing a trip signal 34 to the microprocessor 30, such as the signal 102 via an analog to digital converter 103, indicating that a sheet 18 has been initially fed by the machine 10. And, one of the sensors 34, i.e., sensor 110, is preferably a reflective sensor which senses light 112 generated thereby and reflected from a sheet 18, in the path of travel 36, for providing a signal 34 to the microprocessor 30, such as the signal 114 via an analog to digital converter 115, indicating that a sheet 18 is substantially ready for printing thereon.

In addition, for controlling operation of the base 12 (FIG. 2) the keyboard switches 42 are preferably a plurality of manually depressible switching keys including a print only mode key 120, which is manually actuatable for causing the base 12 to enter into a sheet feeding and printing mode of operation. In addition, the keyboard switches 42 include a seal-only mode key 122, which is manually actuatable for causing the base 12 to enter a sheet feeding but no printing mode of operation wherein an envelope 18B is fed into engagement with the flap deflecting blade 21, moistened by the moistening structure 20 and sealed by the sheet feeding rollers 17B in the course of being fed through the postage meter 14. Moreover, the keyboard Switches 42 include a print and seal key 124, which is manually actuatable for causing the base 12 to enter into a sheet feeding, flap deflecting, moistening and printing mode of operation. Further, for providing a visual indication to an operator concerning a trouble or error condition in the machine 10, the keyboard 40 preferably includes a service lamp 125, which is preferably intermittently energized in a light blinking mode of operation in response to appropriate signals 48 from the microprocessor 30 whenever the base 12 is in need of servicing, for example, due to the occurrence of a jam condition event in the course of operation thereof. For redundantly storing critical data, including a plurality of error codes, utilized for operation of the base 12 in various modes of operation thereof, the microprocessor 30 is preferably one of the type which not only includes a random access memory (RAM) 30A, but also includes a suitable non-volatile memory (NVM) for storing such data, including error codes, without loss thereof due to power failure or during power-down conditions. Accordingly, the microprocessor 30 preferably includes an electrically erasable, programmable, read only, memory (EEPROM) 30B for storing such data, including error codes, corresponding to malfunction conditions which occur at any time during energization of the machine 10.

Moreover, for controlling operation of the base 12 (FIG. 2), the base 12 preferably includes a manually actuatable test key 126 which is disposed within the base 12, beneath a cover 128 suitably mounted to the framework 13, for access upon removal of the cover 128, to normally permit use solely by manufacturing and maintenance, i.e., service, personnel. Accordingly, the test key 126 is preferably connected to the framework 13 beneath the cover 128 for normally preventing access thereto by an operator of the machine 10. The test key 126 is conventionally electrically connected to the microprocessor 30 and is manually actuatable to provide appropriate signals 46 to the microprocessor 30 for causing the base 12 to enter into a service mode of operation wherein stored data corresponding the error codes identifying respective malfunction conditions can be retrieved and displayed on the display 44. Further, the base 12, and in particular the keyboard 40, preferably includes a clear key 129 which is manually actuatable, when the base 12 is in the service mode of operation thereof, for clearing from both the RAM 30A and EEPROM 30B the data corresponding to error codes stored therein. Moreover, for the purposes of this disclosure, unless otherwise stated, actuation of a given key, 120, 122, 124, 126 or 129, means that the relevant key has been moved, and holding the key moved for any length of time before release does not have any additional effect.

Figure 3A:
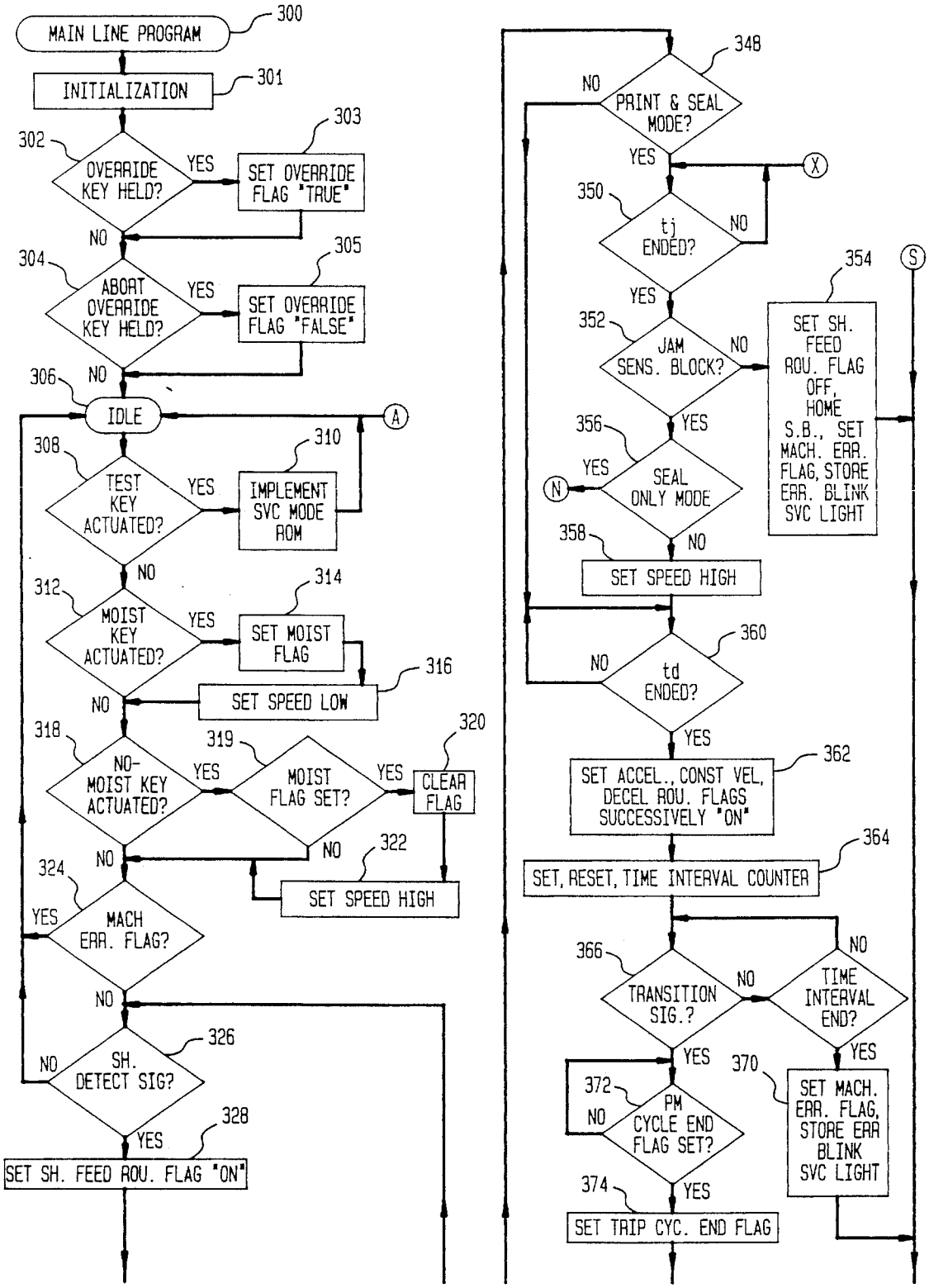
FIG. 3 a flow chart of a process for discriminating between sheets of different lengths in the mailing machine of FIG. 1.

As shown in FIG. 3, in accordance with the invention upon manual movement of the power switch 15A to the "on" position, the base 12 and thus the microprocessor 30 is conventionally energized. Whereupon the microprocessor 30 commences execution of the main line program 300. The main line program 300, commences with the step 301 of causing the microprocessor 30 to initialize, which generally entails setting the voltage levels for the various sensors 34, including the sensors 92, 96 and 110, motors 26A, 26B and 26C, solenoid 21B, clock and data leads 86 and 88, and if they are not in their respective home positions, driving the motors 26A, 26B and 26C thereto. In addition, the initialization step 301 preferably includes the function of operating the solenoid 21B for positioning the baffle 21A beneath the deck 17, and thus in the non-flap moistening position thereof. Further, the initialization step preferably includes setting the sheet feeding speed for use by the sheet feeding routine 400 to a high sheet feeding speed, i.e., preferably twenty-six inches per second (26"/sec.), as distinguished from a low speed, i.e., preferably seventeen and one-half inches per second (17 ½ "/sec.). Thereafter, the main line program 300 causes the microprocessor 30 to execute the step 302 of determining whether the override key, that is, a predetermined one of the keys 120, 122 or 124, is held actuated. In this connection it is noted that as hereinafter discussed the program 300 includes process steps for determining whether a given sheet 18 fed to the machine 10 is less than a predetermined minimum length of at least five inches (5"), and, if it is, shutting down the sheet feeding and printing operations of the machine 10. And, that such process steps are desirable on a world-wide basis except, most notably, in Japan, where envelopes are not fed lengthwise through mailing machines, but rather are fed widthwise therethrough, as a result of which the aforesaid process steps, concluding with machine shut down upon detection of a sheet of less than the predetermined minimum length, are undesirable. Thus, the invention includes the provision of the override key for causing the microprocessor 30 to override implementation of the shut-down associated with minimum sheet-length processing. In addition, in order to abort the override process to accommodate, for example, installing in another country a mailing machine which was installed in Japan, the invention additionally includes the provision of an abort-override key which is actuatable for causing the microprocessor 30 to execute steps which re-enable implementation of minimum sheet-length processing. Accordingly, referring back to step 302, and assuming that the override key 120, 122 or 124 is held actuated, then, the program 300 causes the microprocessor 30 to execute the step 303 of setting the override flag "true" or "on" for use as hereinafter discussed. Assuming however, that the inquiry of step 302 is negatively answered, or that step 303 was executed when the machine 10 was previously energized, then, the main line program 300 causes the microprocessor 30 to execute the step 304 of determining whether an abort-override key, that is, a predetermined different one of the keys 120, 122 or 124, is held actuated. Assuming that the inquiry of step 304 is affirmative, then, the program 300 causes the microprocessor 30 to execute the step 305 of setting the override flag "flase" or "off" for use as hereinafter discussed. And, assuming that the inquiry of step 304 is negatively answered, or that step 305 was executed when the machine 10 was previously energized, then, the main line program 300 causes the microprocessor 30 to execute the step 306 of entering into an idle loop routine.

As thus constructed and arranged the operator has an opportunity to hold either the override or abort-override key, 120, 122 or 124 (FIG. 2), depressed, when the power switch 15A is actuated, to cause the main line program 300 (FIG. 3) to set an override flag either "true" or "flase" for use in disabling or re-enabling the minimum-length processing as hereafter discussed. Further, as thus constructed and arranged, assuming disablement of minimum sheet length processing, re-enablement cannot occur until the abort-override key, 120, 122 or 124, is held depressed, and, assuming re-enablement of minimum sheet-length processing, disablement cannot occur until the override key is held depressed. Moreover, as a practical matter, since the inquiries of steps 302 and 304 are implemented by the microprocessor 30 soon after actuation of the power switch 15A, for energization of the machine 10, both of the inquiries of steps 302 and 304 will be negatively answered unless the appropriate override or abort-override key 120, 122 or 124, is held actuated at the time of actuation of the power switch 15A.

As shown in FIG. 3, the idle loop 306, commences with the step 308 of determining whether or not the test key 126 (FIG. 2) has been actuated. Assuming that the test key 126 is actuated, step 308 (FIG. 3), then, the program 300 causes the microprocessor 30 to execute the step 310 of calling up and causing implementation of the service mode routine 800, in the course of which the error codes stored in the memories 30A and 30B may be displayed on the display 44, followed by returning processing to idle, step 306. Assuming however, that the test key 126 (FIG. 2) is not actuated, step 308, then, the program 300 executes the step 312 of determining whether or not a moistening key, i.e., one or the other of the seal only or print and seal keys, 122 or 124, has been actuated. Assuming the inquiry of step 312 is affirmatively answered, then, the program 300 causes the microprocessor 30 to execute the step 314 of setting a moistening flag, resulting in the microprocessor 30 (FIG. 2) calling up and implementing the baffle routine 700, for causing the solenoid 21B to be operated to raise the baffle 21A to the position thereof wherein envelopes 18B fed to the base 12 are guided by the baffle 21A into engagement with the envelope flap deflecting blade 21 for downstream moistening by the moistening structure 20. Thereafter the program 300 causes the microprocessor 30 to execute the step 316 of causing the microprocessor 30 to set the sheet feeding speed of the sheet feeding routine 400 to the "low" speed of preferably 17½" per second. Accordingly, if one or the other of the moistening keys, 122 or 124 (FIG. 2), is actuated, the baffle 21A is located in the envelope flap moistening position for guiding envelopes 18B into engagement with flap deflecting blade 21, and the sheet feeding speed is reduced. In this connection, it is noted that the "low" speed is a speed which is lower than the sheet feeding speed of 26"/second set in the course of microprocessor initialization, step 301 (FIG. 3, and thus less than the speed at which the printing structure 50 (FIG. 2) of the postage meter 14 prints indicia 51E on an envelope 18B.

Assuming however, that the inquiry of step 312 (FIG. 3) is negatively answered, or that step 316 has been executed, then, the program 300 causes the microprocessor 30 to execute the step 318 of determining whether the no-moisten key, i.e., the print only key 120, has been actuated. Thereafter, assuming the inquiry of step 318 is affirmatively answered, the program 300 causes the microprocessor 30 to execute the step 319 of determining whether the moistening flag is set, due to steps 314 and 316 having been implemented, and assuming it is the program 300 causes the microprocessor 30 to execute the step 320 of clearing the moistening flag, which results in causing the microprocessor 30 to implement the baffle routine 700 for causing the solenoid 21B (FIG. 2) to be deenergized to permit the spring 21D to urge the baffle 21A downwardly to the position thereof beneath the deck 17 wherein the baffle 21A guides envelopes 18B, or other sheets 18 fed to the machine 10, out of engagement with the envelope flap deflecting blade 21 and thereover for bypassing the flap moistening function of the moistening structure 20. Moreover, following execution of step 320 (FIG. 3), the program 300 causes the microprocessor 30 to set the sheet feeding speed of the sheet feeding routine 400 to the high speed of preferably 26"/second, which corresponds to the linear speed of the periphery of the postage indicia printing drum 51 when printing indicia 51E on a given sheet 18. Thus, if the non-moistening, or print only key, 120 (FIG. 2), actuated, the baffle 21A is located in the non-flap moistening position, if it is not already so located, for guiding envelopes 18B out of engagement with the flap deflecting blade 21, and the sheet feeding speed is increased. Accordingly, assuming execution of steps 319 or 322, or that the inquiry of step 318 is negatively answered, then, the program 300 causes the microprocessor 30 to execute the step 324 of determining whether a machine error flag has been set.

As hereinafter discussed in greater detail, a machine error flag is set, step 324 (FIG. 3), due to the occurrence of various events, including, for example, that the sheet feeding structure 16 (FIG. 1) has been jammed in the course of feeding a sheet 18 through the machine 10, that the shutter bar 51D (FIG. 2) has not been fully moved in the course of movement thereof either out of or into locking engagement with the drum drive gear 51C, or that the meter drive train 28 has become jammed in the course of driving the same. Assuming a machine error flag has been set, step 324 (FIG. 3), then, the program 300 returns processing to idle 306, until the condition causing the error flag to be set is cured and the error flag is cleared, and a determination is thereafter made that an error flag is not set, step 324. Thereafter the program 300 causes the microprocessor 30 to implement the step 326 of determining whether a sheet detection signal 94 (FIG. 2) has been received from the sensor 92 due to a sheet 18 having been fed to the machine 10. Assuming a sheet 18 has not been fed to the machine 10, with the result that a sheet detection signal 96 has not been received, step 326 (FIG. 3), then, the program 300 causes processing to loop to idle, step 306, and to thereafter continuously loop through steps 308 through 326, as appropriate, until the sheet detection signal 94 is received. Whereupon, the program 300 causes the microprocessor 30 to implement the step 328 of setting the sheet feeder routine flag "on", which results in the program 300 calling up and implementing the sheet feeding routine 400. Thus the machine 10 responds to the detection of a sheet 18 fed to the machine 10 by commencing feeding the sheet 18 through the machine 10.

As the sheet feeding routine 400 (FIG. 3) is being implemented, the program 300 concurrently causes the microprocessor 30 to implement the step 330 of determining whether the sheet detection signal 94 has ended, that is, whether the trailing edge 101 (FIG. 2) of a sheet 18 being fed downstream in the path of travel 36 by the input sheet feeding rollers 17B has unblocked the sensor 92. Assuming the sensor 92 is not unblocked, then, the program 300 (FIG. 3) causes the microprocessor 30 to implement the step 332 of determining whether the sheet feeding trip signal flag has been set, indicating that the sensor 96 (FIG. 2) has detected the leading edge 100 of the sheet 18 and provided a trip signal 102 to the microprocessor 30. Assuming the microprocessor 30 determines that the sheet detection signal 94 has not ended, step 330 (FIG. 3) and, in addition, that the sheet feeding trip signal flag has not been set, step 332, then, the program 300 returns processing to step 330 and continuously successively implements steps 330 and 332 until the sheet feeding trip signal 102 is received, step 332, before the sheet detection signal 94 is ended, step 330, or the sheet detection signal 94 is ended, step 330, before the sheet feeding trip signal 102 is received, step 332.

Assuming the sheet feeding trip signal is received, step 332 (FIG. 3) before the sheet detection signal is ended, step 330, then, the program 300 causes the microprocessor 18 to execute the step 336 of starting two the of timers 30D (FIG. 2) to separately commence counting two predetermined time intervals, td and tj from the time instant that the leading edge 100 of the sheet 18 is sensed by the sheet detection sensor 96. The time delay td is a predetermined time delay before the microprocessor 30 will commence driving the printing motor 26B and thus the drum 51 through a printing cycle commencing with accelerating the postage printing drum 51 from rest and thus the drum 51E on the sheet 18 sensed by trip sensor 96. And the time delay which tj is a predetermined time delay, which is less than or equal to the time delay td, permitted to lapse before it may be concluded that a malfunction, or jam condition, has occurred at the flap deflecting blade 21, due, for example, to a sealed envelope 18B having been fed to the machine 10 when the baffle 21A is positioned for guiding sheets 18 into engagement with the flap deflecting blade 21. Accordingly, the counts of each of the time intervals, td and tj, are commenced if the program 300 determines that the sensors 92 and 96 (FIG. 2) are concurrently blocked, indicating that the operator has fed a sheet 18 to the machine 10 which is longer than the physical distance "d", of substantially six inches (6"), between the sensors 92 and 96, and that the operator has not withdrawn the sheet 18 before the input sheet feeding rollers 17B have fed the sheet 18 into blocking relationship with the trip sensor 96.

Assuming however that the sheet detection signal is ended, step 330 (FIG. 3), before the trip signal is received, step 332, then, the program 300 causes the microprocessor 30 to start a third timer 30D (FIG. 2) to commence counting a predetermined sheet-length time delay tsl. In this connection it is noted that if the length of the sheet 18 fed to the machine 10 is less than the physical distance "d" of substantially 6" between the sensors 92 and 96, and either is or is not also less than a minimum desirable length of preferably substantially four and three-quarters inches (4¾") and, in addition, is not withdrawn by the operator after having been fed into sensing relationship with the sensor 92, then, the inquiry of step 330 will be affirmatively answered before the inquiry of step 332 is affirmatively answered, with the result that the program 300 causes the microprocessor 30 to execute step 331. In addition, it is noted that the program steps 331A through 333B are provided to discriminate between sheets 18 which are not of sufficient length to span the physical distance "d" of 6" between the sensors, 94 and 96, but may or may not by less than the minimum desirable processing length, and to stop processing such sheets 18 which have a length of less than the desirable minimum length of substantially 4¾" unless the override key 120, 122 or 124 has been actuated as hereinbefore discussed. In this connection it is noted that due to steps 331A through 333B, as appropriate, being executed when the sheet feeding speed is set at either the "low" speed of 17½"/second or the "high" speed of 26"/second, sheets 18 having an overall, longitudinal, length of 4½" or less will always be found to be less than the minimum desirable length of substantially 4¾" and those having a length of 5" or more will always be found to be greater. And, at "high" speed, sheets 18 of less than 5" in length will be found to be less than the minimum acceptable length of substantially 4¾", whereas at "low" speed, sheets 18 of less than 4½" in length will be found to be less than the minimum acceptable length of substantially 4¾". Accordingly, substantially 4¾" is intended to means 4½" to 5" in length.

With the above thoughts in mind, following execution of step 331 (FIG. 3) the program 300 causes the microprocessor 30 to execute the step 331A of determining whether the sheet length time interval tsi is equal to a maximum predetermined assuming the inquiry of step 331A is negative, the program 300 causes the microprocessor 30 to execute the step of determining whether the sheet fed trip signal flag is set, i.e., the sheet 18 fed to the machine 10 has been detected by the trip sensor 96, a signal 104 corresponding to such detection has been provided to the microprocessor 30 and flag corresponding thereto has been set thereby. Thereafter, program causes the microprocessor to continuously loop through steps 331A and 332A, until the inquiry of step 331A is affirmatively answered before the inquiry of step 332A is affirmatively answered, or the inquiry of step 332A is affirmatively answered before the inquiry of step 331A is affirmatively answered. Assuming the inquiry of step 332A is affirmatively answered before the inquiry of step 331A is affirmatively answered, then, the program causes the microprocessor 30 to execute the step 333 of determining whether the override flag setting is "true" or "on", indicating that minimum sheet-length processing should be discontinued. Accordingly, assuming the inquiry of step 333 is affirmative, processing proceeds to step 336 which is, as hereinbefore discussed, the step to which processing proceeded when a determination was made in steps 330 and 332 that both sensors 92 and 96 were blocked by a sheet 18 having a length equal to or greater than the physical distance "d" of six inches between the sensors 92 and 96. Or, otherwise stated an affirmative response to the inquiry of step 333 results in minimum sheet-length processing being ended and sheet processing to proceed as if the sheet length were acceptable.

On the other hand, assuming the inquiry of step 333 (FIG. 3) is negatively answered, then, the program 300 causes the microprocessor 30 to execute the step 333A of determining whether the sheet length time interval tsl is greater than or equal to a time period of substantially 40 milliseconds. Assuming a sheet feeding speed of 26" per second, if the inquiry of step 333A is negatively answered, the given sheet 18 is equal to or more than the minimum desirable length of 5", since within less than forty milliseconds from the trailing edge 101 of a given sheet 18 unblocking the sheet detection sensor 92, step 330, the leading edge 100 of the sheet 18 has been detected by the trip sensor 96. As a result, the program 300 causes the microprocessor 30 to proceed to execution of step 336. If however the inquiry of step 333A is affirmatively answered, indicating that the given sheet is less than the minimum acceptable length of 5" at the sheet feeding speed of 26"/second, since at least 40 milliseconds has passed since the sheet's trailing edge 101 unblocked the sheet's detection sensor 92 and the sheet leading edge 100 blocked the trip sensor 96, then, the program 30 causes the microprocessor 30 to execute the step 333B of setting a machine error flag, storing an error code corresponding to a short-sheet, or undesirable, sheet length, and blinking the service light 125 to visually display the malfunction condition. Referring back to step 331A, and assuming that the maximum sheet length time interval is one second, and, the inquiry of step 331A is affirmatively answered before the inquiry of step 332A is affirmatively answered, then, the program 300 causes the microprocessor 30 to execute the step 334 of setting the sheet feeding trip signal flag "off" for shutting down processing of the sheet feeding routine 400, followed by returning processing to step 326 to await the next sheet detection signal 94. In this connection it is noted that if one second elapses from the time instant that the sheet detection sensor 92 is unblocked step 330 and the trip sensor 96 is still not blocked, step 332A, then, it may be concluded that the operator has withdrawn the sheet 18 from the machine 10.

Thereafter, the program 300 causes the microprocessor 30 to execute the step 340 of determining whether the base 12 is in a print mode of operation as a result of the operator having actuated either one or the other of the print only or print and seal keys, 120 or 124. Assuming the inquiry of step 340 is negatively answered, then, the program 300 concludes that the base 12 is in the no-print, or seal only, mode of operation, as a result of the operator having actuated the seal only key 122 (FIG. 2). Assuming that the seal only key 122 has been actuated, step 340 (FIG. 3), due to the operator having chosen to use the base 12 (FIG. 2) for sheet moistening and sealing purposes and not to use the postage meter 14 for printing purposes, then, the program 300 (FIG. 3) bypasses all printing related steps, including the step 342 of causing the microprocessor 30 to move the shutter bar 51D out of looking engagement with the drum drive gear 51C, and causes the microprocessor 30 to implement the step 350 of determining whether the jam time delay tj has ended. Assuming that the jam time delay tj has not ended, then, the program 300 causes the microprocessor 30 to continuously loop through step 350 until the jam time delay tj has ended. Whereupon the program 300 causes the microprocessor 30 to execute the step 352 of determining whether the jam sensor 110 (FIG. 2) is blocked. Assuming as is the normal case that the inquiry of step 352 is affirmative, indicating that the sheet 18 has been fed beyond the flap deflecting blade 21 and has not therefore been jammed against the blade 21, then, the routine 300 causes the microprocessor 30 to execute the step 356 of again determining whether the machine 10 is in the seal only mode, since the processing commencing with step 350 follows either step 340 or step 348. Assuming the inquiry of step 356 is affirmative, then, the program 300 causes the microprocessor 30 to bypass subsequent printing related steps, including the step 362 of causing the microprocessor 30 to call-up and execute the postage printing drum driving routine 600, and instead, causes the microprocessor 30 to execute the step 388 of implementing a time delay of sufficient length to permit the sheet 18 to be fed from the machine 10, followed by returning processing to idle 306. Referring back to step 340 and assuming that the inquiry thereof is affirmatively answered, indicating that the machine 10 is in either one of the printing modes of operation due to the operator having has actuated either the print only key 120, to cause the baffle 21A to be positioned for guiding sheets 18 fed to the machine 10 out of engagement with the flap deflecting blade 21 for bypassing the moistening structure 20, or the print and seal key 124, to cause the baffle 21A to be positioned for guiding sheets 18 into engagement with the flap deflecting blade 21 for flap moistening purposes, then, the program 300 (FIG. 3) implements the step 342 of setting the shutter bar routine flag "on", which results in the program 300 causing the microprocessor 30 to call up and implement the shutter bar routine 500 for driving the shutter bar 51D (FIG. 2) out of locking engagement with the drum drive gear 51.

As the microprocessor 30 (FIG. 2) implements the shutter bar routine 500, the program 300 (FIG. 3) concurrently causes the microprocessor 30 to implement the step 344 of determining whether a shutter bar time-out flag has been set, indicating at this juncture that either the postage meter 14 (FIG. 2) is improperly mounted on the base 12 or has for reasons beyond the scope of this invention prevented movement of the shutter bar 51D out of locking engagement with the drum drive gear 51, or the shutter bar 51D has been stopped due to a malfunction condition in the base 12 which interferes with the lever arm 29 driving the shutter bar 51D. Assuming that the shutter bar time-out flag is set, step 344 (FIG. 3), then, the program 300 implements the step 346 of setting a machine error flag, storing an error code in the both the RAM 30A and EEPROM 30B and causing the keyboard service lamp 125 to commence blinking, followed by the step 384 of implementing a the shut-down routine 900 and then the step 386 of clearing the error flag and returning processing to idle 306. If however, as the normal case, that the inquiry of step 344 is negatively answered, then, the program 300 causes the microprocessor 30 to implement the step 348 of determining whether the machine 10 is in the print and seal mode of operation, due to the operator having actuated the print and seal key 124, causing the baffle 21A to be positioned for guiding envelope flaps 19A into engagement with the flap deflecting blade 21. Assuming that the machine 10 is not in the print and seal mode of operation, step 348, then, the program 300 causes the microprocessor 30 to execute step 360, hereinafter discussed, of determining whether the time td delay has ended. If however, the inquiry of step 348 is affirmatively answered, due to the operator having actuated the print and seal key 124, then, the program 300 causes the microprocessor 30 to execute the step 350 of determining whether the jam time interval tj has ended. Assuming that the inquiry of step 350 is negative, the program 300 causes microprocessor processing to continuously loop through step 350 until the jam time interval tj is ended. Whereupon, the program 300 causes the microprocessor 30 to execute the step 352 of determining whether the jam sensor 110 (FIG. 2) is blocked. Assuming the jam sensor 110 is not blocked, as it should be by the time the jam time delay tj has ended, then, the inquiry of step 352 will be negatively answered, indicating that a jam condition has occurred between the time the sheet 18 was sensed by the trip sensor 96 and the jam time interval tj has ended. Thus the program 300 recognizes when a sheet 18 (FIG. 2) is jammed against the flap deflecting blade 21. As a result of the negative response to the inquiry of step 352 (FIG. 3), the program 300 causes the microprocessor 30 to execute the step 354 of setting the sheet feeder routine flag off, to shut down the sheet feeding routine 400, and to execute the shutter bar routine 500 for causing the shutter bar 51D (FIG. 2) to be returned into locking engagement with the postage printing drum drive gear 51C, thereby preventing rotation of the printing drum 51. In addition, the microprocessor 30 is caused to set a machine error flag, store an error code as hereinbefore discussed, and blink the service light 125, followed by the successive steps 384 and 386 of causing the microprocessor 30 to implement the shut down routine 900, clearing the error flag and returning processing to idle 306. Assuming however, as is the normal case, that the inquiry of step 352 is affirmatively answered, indicating that the sheet 18 has been fed into blocking relationship with the jam sensor 110 (FIG. 2) and is not therefore jammed at the flap deflecting blade 21, then, the program 300 causes the microprocessor 30 to execute the step 356 of determining whether the machine 10 is in the seal only mode of operation thereof, as a result of the operator having actuated the seal only key 122 (FIG. 2) to cause the baffle 21A to be located for guiding sheets 18 out of engagement with the flap deflecting blade 21 and to cause printing to be bypassed as hereinbefore discussed. Accordingly, if the inquiry of step 356 is affirmatively answered, then, the program 300 causes the microprocessor 30 to bypass all printing related steps, including the step 352 of setting the printing routine flag "on" for causing printing to be implemented, and instead to execute the step 388 of implementing the time delay permitting the sheet 18 to exit the machine 10, followed by returning processing to idle 306. If however, the inquiry of step 356 is negatively answered, indicating that printing should occur, then, the program 300 causes the microprocessor 30 to execute the step 358 of setting the sheet feeding speed of the sheet feeding routine 400 to the high speed of 26"/second, as hereinbefore discussed, followed by executing the step 360 of determining whether the time delay td has ended. Assuming the time delay td is not ended, then, the program 300 causes the microprocessor 30 to continuously loop through step 360 until the time delay td is ended. Whereupon the program 300 causes the microprocessor 30 to execute the step 362 of setting the postage meter acceleration, constant velocity and deceleration routine flags successively "on", which results in the program 300 calling up and implementing the postage meter acceleration, constant velocity and deceleration, or postage printing, routine 600.

As the postage printing routine 600 is being implemented, the program 300 (FIG. 3) concurrently implements the successive steps, 364 through 368, of successively clearing and setting a time interval counter for counting a series of predetermined fault time intervals during which the microprocessor 30 preferably receives transition signals 38 from the sensing structure 34 indicating that the postage printing drum 51 has commenced being driven from its home position, has timely achieved constant velocity, has been timely driven at the constant velocity during the printing cycle and has been timely decelerated back to rest at its home position, without having been jammed in the course of such movement, failing which, the program 300 causes the microprocessor 30 to execute the successive steps 370, 384 and 386 of setting a machine error flag, storing an error code and blinking the service light 125, followed by implementing the shutdown routine 900, clearing the error flag and returning processing to idle, step 306. Accordingly, if the postage printing drum 51 is not timely driven from and the back to its home position after commencement of implementation of the postage meter printing routine 600, step 362, the program 300 shuts down all sheet processing and provides a visual indication to the operator that the mailing machine base 12, or postage meter 14, or both, are in need of servicing. At this juncture, the operator of the machine 10 may find, for example, that the drum 51 did not move from its home position, due to the postage meter 14 having insufficient funds to print the postage value entered therein by the operator for printing purposes, or some other error condition has occurred in the meter 14 which preludes driving the drum 51 from its home position. Alternatively, the operator may find that a jam condition exists in the base 12 which prevents the drum drive gear 51C from driving the drum 51. Whatever may be the reason for the drum 51 not being timely moved from and then back to its home position during the various fault time intervals, the operator would normally attempt to cure the defect in machine operation, failing which a service person would be called in to cure the defect.

However, assuming as is the normal case, that a determination is made in step 366 that all of the transition signals are timely received, i.e., before the fault time intervals are ended, step 364, then, the program 300 causes the microprocessor 30 to implement the step 372 of determining whether the postage meter cycle ended flag has been set, due to the postage meter printing routine 600 having driven the drum 51 through a single printing cycle. Assuming that the postage meter cycle ended flag has not been set, step 372, then, the program 300 continuously causes the microprocessor 30 to implement step 372 until the postage meter cycle ended flag has been set. Whereupon, the program 300 causes the microprocessor 30 to implement the step 374 of setting a postage meter trip cycle complete flag. As thus constructed and arranged, in the course driving the postage printing drum 51 through a printing cycle, including acceleration of the postage meter drum 51 from its home position to a constant velocity for printing purposes and then decelerating the drum 51 back to rest at its home position, the microprocessor 30 repeatedly determines whether the difference between desired and actual movements of the drum 51 are acceptable, failing which, an error code is stored in each memory, 30A and 30B, and a shut-down routine 900 is implemented.

Assuming the postage meter printing cycle has ended, step 372 and 374 (FIG. 3), then, the program 300 causes the microprocessor 30 to execute the step 376 of determining whether the machine 10 is in a moistening mode of operation, due to the operator having depressed either one of the seal only or print and seal keys, 122 or 124, and the baffle 21A being positioned for guiding sheets 18 into engagement with the envelope flap deflecting blade 21 for subsequent moistening by the moistening structure 20. In connection with step 376 it is noted that for printing purposes, although the machine 10 may be in the print and seal mode of operation, step 348 (FIG. 3), the sheet feeding speed has been set to high speed of 26"/second, step 358, for printing purposes, step 362. Accordingly, the inquiry of step 376 is made to determine whether the sheet feeding speed should be returned to low speed for processing the next sheet 18. If the next sheet 18 is not one which is to be moistened, then the program 300 causes the microprocessor 30 to execute the step 378 of setting the shutter bar routine flag on, which results in the microprocessor 30 calling up and implementing the shutter bar routine 500 for driving the shutter bar 51D (FIG. 2) back into locking relationship with the drum drive gear 51C to prevent printing. Assuming however that the inquiry of step 376 is affirmative, then, before implementation of step 378, the program 300 causes the microprocessor 30 to execute the step 380 of setting the sheet feeding speed of the sheet feeding routine 400 to the low speed of 17.5"/second for envelope moistening purposes. After implementation of step 378, the program 300 causes the microprocessor 30 to execute the step 380 of determining whether the shutter bar time out flag is set, that is, determining whether the shutter bar 51D has been timely returned to locking relationship with the postage printing drum drive gear 51C to prevent printing. Assuming the postage printing drum 51 has not been timely locked against rotation then, the program 300 causes the microprocessor 30 to execute the step 382 of setting a machine error flag, storing an error code and blinking the service light 125, followed by execution of the steps, 384 and 386, of implementing the shutdown routine 900, clearing the error flag and returning processing to idle 306. If however, the shutter bar time out flag is not set, step 380, indicating that the drum 51C has been timely locked against movement, then, the program 300 causes the microprocessor 30 to execute the step 388 of delaying processing for a time interval sufficient to permit the processed sheet 18 to exit the machine 10, followed by returning processing to idle 306.

As thus constructed and arranged the microprocessor 30, and thus the machine 10, includes structure for feeding sheets 18 at speed which is lower then the printing speed for moistening purposes, and, after moistening, feeding such sheets 18 at a higher speed for printing purposes. Moreover, the machine 10 is constructed and arranged for detecting a jam condition at the flap deflecting blade 21, occasioned for example by an operator feeding a sealed envelope 18B to the machine 10 when the machine 10 is in a moistening mode of operation, whereby the baffle 21A is positioned for guiding sheets 18 into rather than out of engagement with the flap deflecting blade 21. Moreover, the machine 10 is constructed and arranged to operate at a low speed for moistening purposes to ensure that sheet feeding may be timely stopped on the occasion of a sheet 18 being jammed against the flap deflecting blade 21, in order to avoid tearing the sheet 18 if it does become jammed, or, if not torn, but slowed down to avoid wasting postage by not printing the indicia 51E fully and legibly on the sheet 18.

What is claimed is:

1. A mailing machine comprising:

a) means for feeding a sheet in a path of travel;

b) means for printing indicia on the sheet;

c) means for controlling the sheet feeding and printing means, the controlling means including a microprocessor, the controlling means including means for sensing the sheet in the path of travel, the sensing means including a first sensor for sequentially sensing the leading and trailing edges of the sheet and providing corresponding sequential first signals to the microprocessor, the sensing means including a second sensor downstream from the first sensor for sensing the leading edge of the sheet and providing a corresponding second sensing signal to the microprocessor; and d) the microprocessor programmed for 1) causing the sheet feeding means to feed the sheet, 2) commencing a count of a first time interval when the trailing edge of the sheet is sensed by the first sensor and ending when the leading edge of the sheet is sensed by the second sensor, 3) determining whether the first time interval count is less than a predetermined second time interval, and 4) terminating sheet feeding if the first time interval count is not less than the predetermined second time interval.

2. The mailing machine according to claim 1 including the microprocessor programmed for causing the printing means to commence a printing cycle at the end of a predetermined time delay from the microprocessor receiving the second leading edge sensing signal if the first time interval count is less than the predetermined second time interval.

3. The mailing machine according to claim 1 including means for energizing the microprocessor, a first manually actuatable switch connected to the microprocessor, and the microprocessor programmed for overriding termination of sheet feeding if the first switch is held actuated when the microprocessor is energized.

4. The mailing machine according to claim 3 including a second manually actuatable switch connected to the microprocessor, and the microprocessor programmed for aborting the overriding program if the second switch is held actuated when the microprocessor is energized and the first switch was previously actuated.

5. The mailing machine according to claim 1 including the microprocessor programmed for causing the printing means to commence a printing cycle at the end of a predetermined time delay from the receiving the second sensing signal if the second sensing signal is received by the microprocessor before the first leading edge sensing signal is ended.

6. The mailing machine according to claim 1 including the microprocessor programmed for causing the sheet feeding means to stop feeding the sheet if the first time interval count is a selected count before the second sensing signal is received by the microprocessor.

7. The mailing machine according to claim 1 including the microprocessor programmed for causing the printing means to commence a printing cycle at the end of a predetermined time delay from the microprocessor determining that the first time interval is less than the predetermined second time interval.

8. The mailing machine according to claim 3 including the microprocessor programmed for causing the printing means to commence a printing cycle at the end of a predetermined time delay from the microprocessor determining that the first switch is actuated.

* * * * *